United States Patent [19]

Berryhill

[11] 4,285,149

[45] Aug. 25, 1981

[54] GRAVE MARKER

[76] Inventor: A. J. Berryhill, 1319 W. 3rd St., Taylor, Tex. 76574

[21] Appl. No.: 123,427

[22] Filed: Feb. 21, 1980

[51] Int. Cl.[3] ..... G09F 19/00

[52] U.S. Cl. ..... 40/124.5; 40/17

[58] Field of Search ..... 40/124.5, 17, 489, 209, 40/10 R, 325

[56] References Cited

U.S. PATENT DOCUMENTS

| | | | |
|---|---|---|---|
| 890,925 | 6/1908 | Rand | 40/489 |
| 1,455,882 | 5/1923 | Harding | 40/124.5 |
| 1,779,234 | 10/1930 | Harris | 40/209 |
| 2,358,009 | 9/1944 | Hogsten | 40/124.5 |
| 2,593,468 | 4/1952 | Marsh | 40/124.5 |
| 2,597,003 | 5/1952 | Johnson | 40/124.5 |

*Primary Examiner*—Gene Mancene
*Assistant Examiner*—Wenceslao J. Contreras
*Attorney, Agent, or Firm*—Cushman, Darby & Cushman

[57] ABSTRACT

A marker for gravesites is provided with an identification holder which has two oppositely located parallel channels of different depth, the transparent shield having opposite edges received in each of the channels and a spring located in one of the channels for engaging the shield to urge the shield fully into the opposite channel.

6 Claims, 3 Drawing Figures

GRAVE MARKER

BACKGROUND AND BRIEF DESCRIPTION OF THE INVENTION

The present invention relates to markers for grave sites, for example, of the type that have a base that lies flush with the surface of the ground but which can be removed when the ground is to be tended. More particularly, the improved grave marker of the present invention provides a secure yet removable inscription plate to identify the grave which is very simple to manufacture and install yet which can be easily opened to facilitate access to the inscription.

In many urban cemeteries, it has been the practice for families to utilize gravesites for multiple burials due to the lack of space or the specific desires of the deceased persons. As an example, it frequently happens that a husband and wife desire to be buried in the same grave and such a practice requires that a grave marker be altered to reflect the addition of the remains of another person.

In the past, to accommodate such additions, temporary grave markers have been used which, over a period of time have been subject to deterioration or vandalism, thus rendering such grave markers inappropriate for use in cemeteries. Also, a number of grave markers of the prior art have relied on pointed posts which are inserted into the ground to hold the grave markers in place. Thus, where mowing or trimming has been required around the grave site, workers have had to pull up the grave markers which has frequently resulted in damage to the grave marker over a period of time.

The present invention has for its objects the elimination of the foregoing difficulties by providing a grave marker, preferably of stone but which may be made of other rigid material wherein the inscription can be securely held in place in the marker and yet access to the inscription can be effected quickly with a simple tool. Further, the inscription will be safe from the elements yet the entire grave marker can be removed very easily by a worker when the grave requires trimming or cleaning without damaging or exposing the inscription to the elements.

The foregoing and other advantages will become apparent as consideration is given to the following detailed description taken in conjunction with the accompanying drawings, in which:

DETAILED DESCRIPTION OF THE INVENTION

Figure 1:
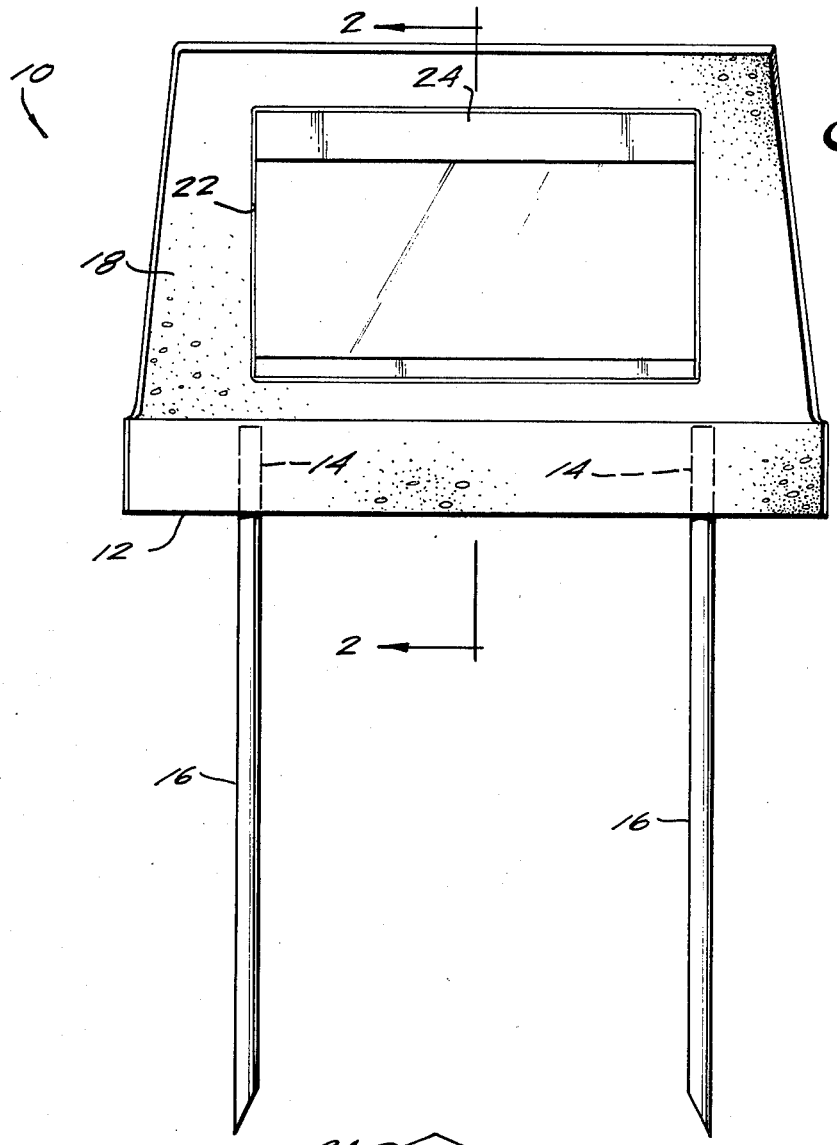
FIG. 1 is a front view in elevation of one embodiment of the grave marker of the present invention.

Referring now to the drawings wherein like numerals designate corresponding parts throughout the several views, there is shown in FIG. 1 the grave marker 10 of the present invention. The marker 10 is preferably cast concrete and may be of a size to be easily lifted and moved about to permit surface care of the grounds. The bottom surface 12 is flat and is provided with spaced apart bores 14 which may be threaded to receive anchoring rods 16 which may be pointed at their lower ends to facilitate insertion into the ground.

The front face 18 of the marker 10 preferably slants at an angle upwardly from the base 20 to permit easy viewing of the front face 10 by a person standing on the ground in front of the marker 10. The front face 18 is formed with a recess 22, which in the illustrated embodiment is generally rectangular in shape and is of sufficient depth to receive an inscription or identification holder means 24.

Figure 2:
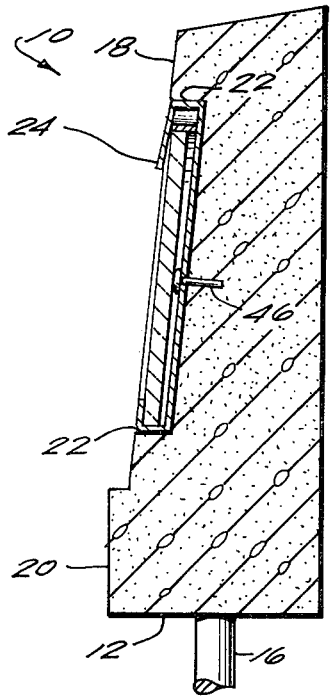
FIG. 2 is a view taken along lines 2—2 of FIG. 1.
Figure 3:
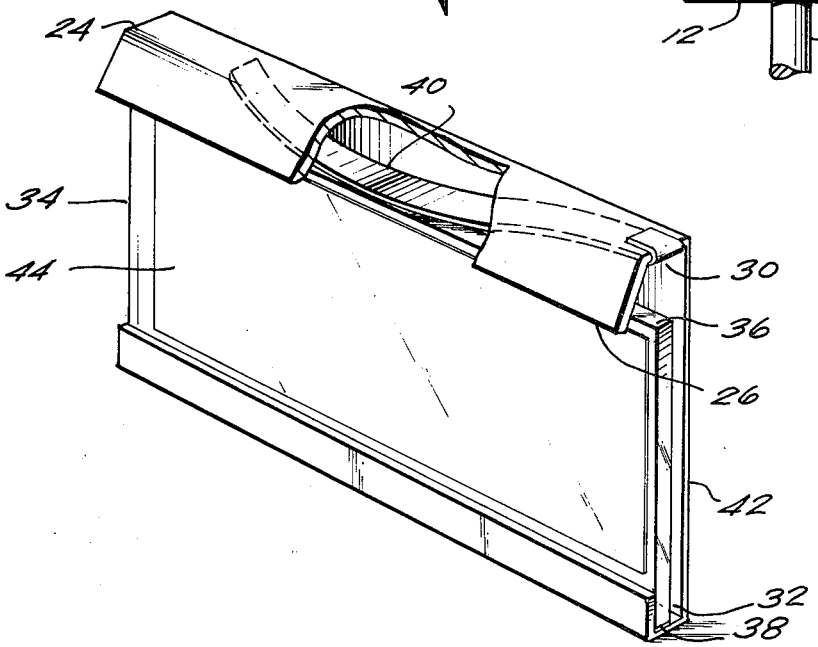
FIG. 3 is an enlarged perspective view of the inscription holder of the present invention.

The inscription holder means 24 is preferably a metal plate which fits snugly into the recess 22. As shown in FIGS. 2 and 3, the holder means 24 has upper and lower edges, 26 and 28, respectively, which are bent towards each other to define receiving channels 30 and 32, respectively. Further, it will be noted that the channel 30 is of greater depth than the lower channel 32. A transparent shield such as a rectangular piece of glass 34 is inserted into the holder means 24 with the upper edge 36 of the shield 34 received in channel 30 and the lower edge 38 of the shield 34 received in channel 32. The width of the shield 34 between edges 36 and 38 should be such that when the shield 34 is pushed into channel 30, the lower edge 38 of the shield 34 can be moved out of channel 32 and over edge 28. To hold the shield 34 in place, a curved or bent plate spring 40 of resilient metal engages the edge 36 as well as the bottom of the channel 30 so as to provide a force constantly urging the shield 34 downwardly into channel 32. The end of spring 40 engages the bottom of channel 30 by having one end thereof bent around the edge of the bottom of the channel whereby the spring 40 is held in place in the channel by engaging that portion of the plate defined by the channel as shown in FIG. 3. Between the back wall 42 and the shield 34 is inserted the grave marker 44 which should be of an appropriate size so as to fully occupy the exposed surface area behind the shield 34 so as to prevent dislodgement or misalignment of the marker 44. The back surface 42 of the holder means 24 is provided with an aperture through which a bolt or rivet 46 may be passed to secure the holder 24 in place in the recess 22 of the marker 10.

As thus far described, it will be apparent that the present invention provides a secure retainer and protector for an identification plate for the grave marker and yet one which can be easily removed for correction, changes or the like. For example, by simply sliding the shield 34 up against the spring 40, the bottom edge 38 of the shield 34 can be pivoted out over the edge 28 by a simple tool such as the end of a screwdriver to permit access to the underlying identification plate or card. Further, the overhanging edge 26 in combination with the spring urging the shield 34 against the bottom of the channel 32 will aid in preventing the ingress of water or moisture, thus protecting the name plate or card inserted behind the shield 34.

Having described the invention, it will be obvious to those skilled in this art that various modifications may be made thereto without departing from the spirit and scope of the invention as defined in the appended claims.

What is claimed is:

1. A marker comprising a body having a face portion, a recess formed in said face portion, identification holder means disposed in said recess, said holder means including a plate having two opposite sides with edges extending toward each other to define parallel extending channels along said two opposite sides, transparent shield means for an identification sheet, said shield means having two opposite edges each disposed in one of said channels, said channels being of different depths, said edge of said plate of said channel of greater depth extending outwardly from said transparent shield means at an angle relative to said transparent shield means, spring means disposed in said channel of greater depth, said spring means being a curved segment of resilient metal having one end thereof bent to engage the bottom of said channel of greater depth whereby said spring means is held in position in said channel of greater depth, said spring means acting between said channel and said edge of said shield means disposed in said channel to urge said shield means toward and into said channel of said opposite side.

2. The marker of claim 1 wherein said plate is securely fastened in said recess.

3. The marker of claim 1 wherein said holder means and said shield means are of such relative dimensions that, when said shield means is urged against said spring means into said channel of greater depth, the opposite edge of said shield means will be moved out of said other channel.

4. The marker as claimed in claim 1 wherein said body has a bottom surface and rod receiving means in said bottom surface.

5. The marker as claimed in claim 4 wherein said rod receiving means are a pair of spaced apart threaded bores and said marker further includes a pair of rods each having threaded ends each inserted into a said bore.

6. The marker as claimed in claim 1 wherein said shield means is a glass plate.

* * * * *